United States Patent [19]

Paridaens

[11] 4,305,018

[45] Dec. 8, 1981

[54] ELECTRON GUN STRUCTURE WITH ELECTRICAL CONTACT SPRING FOR COLOR TELEVISION DISPLAY TUBE

[75] Inventor: Cornelius J. H. Paridaens, Eindhoven, Netherlands

[73] Assignee: U.S. Philips Corporation, New York, N.Y.

[21] Appl. No.: 83,010

[22] Filed: Oct. 9, 1979

[30] Foreign Application Priority Data

Oct. 12, 1978 [NL] Netherlands ..... 7810251

[51] Int. Cl.[3] ..... H01J 29/02; H01J 29/50

[52] U.S. Cl. ..... 313/417; 313/457

[58] Field of Search ..... 313/457, 417, 451

[56] References Cited

U.S. PATENT DOCUMENTS 3,745,397 7/1973 Yamazaki et al. ..... 313/417

3,838,306 9/1974 Jenne, Jr. ..... 313/417 X 4,100,453 7/1978 van den Einden et al. ..... 313/417

*Primary Examiner*—Palmer C. Demeo

*Attorney, Agent, or Firm*—Thomas A. Briody; David R. Treacy; Robert J. Kraus

[57] ABSTRACT

In a color television display tube the electron gun system constructed from three electron guns comprises a first group of corresponding electrodes and a second group of corresponding electrodes to be operated at a higher electrical potential than the first group. The electrodes in each group are positioned relative to each other by means of metal braces connected thereto. The ends of the braces are secured to insulating support rods. At least one group of corresponding electrodes is interconnected by means of one or more conductive contact springs surrounding the support rods and touching the surface of each electrode or of the brace connected thereto.

4 Claims, 4 Drawing Figures

ELECTRON GUN STRUCTURE WITH ELECTRICAL CONTACT SPRING FOR COLOR TELEVISION DISPLAY TUBE

BACKGROUND OF THE INVENTION

The invention relates to a colour television display tube comprising an electron gun system having three electron guns each extending along a longitudinal axis. Each electron gun comprises, in the direction of propagation of the electron beam generated thereby, a first electrode which is electrically-connected to a corresponding first electrode of each of the other guns, and a second electrode which is to be operated at a higher electrical potential than the first electrode, and is electrically-connected to a corresponding second electrode of each of the other guns. The first and second electrodes are secured to support rods of an insulating material by means of metal braces connected thereto.

In an electron gun system of the type comprising three electron guns having substantially identical electrode construction, certain electrodes should have the same potential during operation of the electron gun system. In practice this is realized by electrically interconnecting these electrodes, also termed corresponding electrodes.

In an electron gun system disclosed in U.S. Pat. No. 3,838,306, said electric connection is effected by a thin metal strip which is welded either to the corresponding electrodes themselves, or to the metal connection braces of said electrodes. These welding operations are carried out before the gun system is assembled so that a packet of three corresponding electrodes connected together by one or more metal strips is obtained. Upon assembling the gun system the electrodes are usually slid on three assembly pins arranged in a fixed relationship to each other. A problem is that the corresponding electrodes united to form a packet have to be slid simultaneously on the three assembly pins. In particular, when the play between the inner wall of the electrodes and the centering surfaces of the assembly pins is small, assembly is a time-consuming and difficult operation. This problem is often compounded because the assembly pins are usually arranged so as to be slightly convergent.

SUMMARY OF THE INVENTION

It is an object of the invention to provide means for the electric interconnection of the corresponding electrodes in a simple manner after assembly of the electron gun system.

The invention is utilized with an electron gun system comprising three electron guns. Each gun extends along a longitudinal axis and includes, in the direction of propagation of the electron beam generated thereby, a first electrode which is electrically-connected to a corresponding first electrode of each of the other guns, and a second electrode, to be operated at a higher electrical potential than the first electrode, which is electrically-connected to a corresponding second electrode of each of the other guns. The first and second electrodes are secured to support rods consisting of an insulating material by means of conductive braces connected thereto. In accordance with the invention at least the first electrodes are electrically-connected by means of at least one conductive contact spring surrounding the supporting rods and touching the surface of each electrode or of the brace connected thereto.

The invention not only presents the advantage that the contact spring(s) can be provided in a simple manner after the assembly of the electron gun system, but also provides an improvement in the high voltage stability of the gun system. This means that, in comparison with known gun systems, the gun system according to the invention is less sensitive to the occurrence of electrical flash-overs during operation of the gun system. During operation of the gun system the insulating supporting rods are charged electrically and a potential arises across the support rods. The distribution of this potential is determined by the gun geometry and the potentials presented to the electrodes. This potential distribution may be disturbed by surface impurities of the insulating support rods and by projections of the electrodes and the braces connected thereto which operate as cold emission sources. It is possible that, as a result of electron bombardment, the potential of the support rods reaches such a high value in localized regions that an electric flash-over occurs to parts of the gun system which are at a lower potential. The possibility of the occurrence of such flash-overs becomes very small in a construction according to the invention because the contact springs for the interconnection of the corresponding electrodes touch the insulating supporting rods and at that area keep the potential at the surface of the support rods at a fixed value.

It is known from U.S. Pat. No. 3,558,954 to suppress the occurrence of such flash-overs in the gun system by means of a metal ring surrounding the gun system at the level of the interface between the electrodes which are operated at a high voltage and the electrodes which are operated at a comparatively low voltage. However, said ring is spaced from the insulating support rods and does not serve to electrically-connect the corresponding electrodes.

The invention may be used both in a gun system in which the axes of the three guns are situated in one plane (also termed the "in-line configuration"), and in a gun system in which the axes of the three guns each pass through a corner of an equilateral triangle (also termed the "delta configuration").

According to an embodiment of the invention, each contact spring has one end engaged around a support rod and has its other end secured to a metal brace contacting one of the corresponding electrodes. The part of the contact spring situated between said ends touches at least one electrode and at least one other supporting rod. To secure the one end of the contact spring to the metal brace, the end is preferably hooked behind an opening provided in the brace. In this case no welding operations whatsoever are necessary for the connection of the spring.

Instead of a number of contact springs it is alternatively possible to electrically-connect the corresponding electrodes by means of one contact spring which surrounds the supporting rods and touches the surfaces thereof.

BRIEF DESCRIPTION OF THE DRAWING

The invention will now be described in greater detail with reference to the drawing, in which.

DESCRIPTION OF THE PREFERRED EMBODIMENTS

Figure 1:
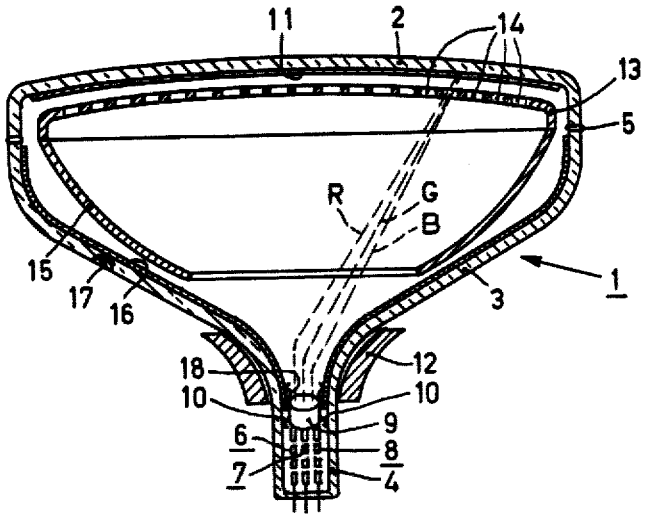
FIG. 1 is a sectional view of a colour television display tube having a multiple electron gun system with three electron guns arranged in in-line configuration and of which a group of corresponding electrodes is electrically interconnected according to the invention.

The colour television display tube shown in FIG. 1 comprises a glass envelope 1 comprising a window 2, a cone 3 and a neck 4. The window 2 is connected to the cone 3 by means of a sealing glass 5. A multiple electron gun system is in the neck 4 and comprises three electron guns 6, 7, 8 arranged according to the "in-line configuration" for generating three electron beams denoted by R, G, B, respectively. The gun system is centered in the neck 4 by means of a centering sleeve 9 connected to the gun system and having centering springs 10 and contact springs 18. The contact springs 18 contact an electrically conductive layer 16 which is provided internally on the wall of the cone and which is connected to a high voltage contact 17 provided in the wall of the cone. The electron beams R, G and B, on their way to a display screen 11 provided internally on the window 2, are deflected by a system of deflection coils 12 placed coaxially around the tube axis. The display screen 11 comprises a plurality of areas luminescing red, green and blue. In the case of an in-line arrangement of the electron guns 6, 7 and 8, said luminescent areas consist of longitudinal phosphor stripes which are perpendicularly oriented with respect to a plane plane through the guns. In the case of a delta arrangement of the electron guns, said luminescent areas consist of triplets of phosphor dots. In order that the three electron beams each impinge only on luminescent areas of one colour, a colour selection electrode 13, in the form of a thin metal sheet having a large number of apertures 14 positioned accurately with respect to the luminescent areas of the display screen 11, is positioned at a short distance from the display screen 11. The electron beams R, G and B pass through the apertures 14 at small angles with respect to each other and consequently each impinges only on luminescent areas of one colour. Also present in the tube is a metal cone 15 which shields the electron beams R, G and B from the earth's magnetic field.

Figure 3:
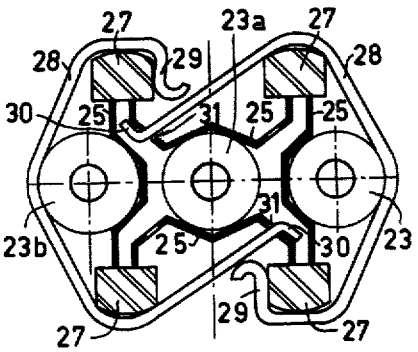
FIG. 3 is a sectional view taken on the line III—III of FIG. 2.
Figure 2:
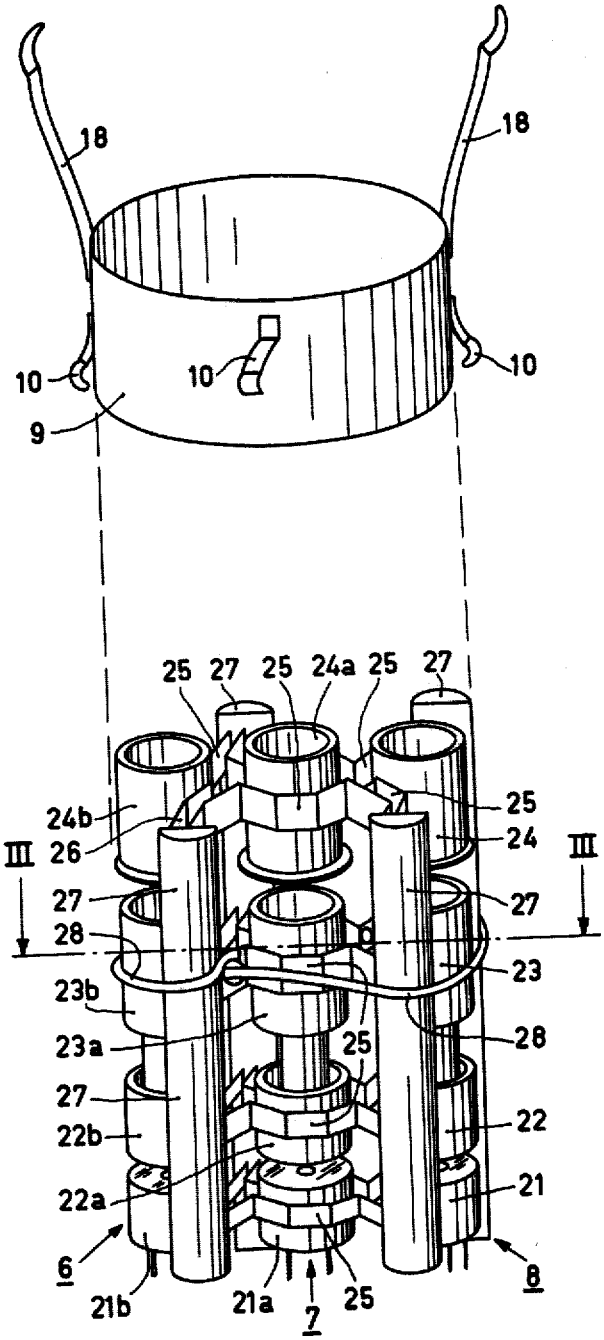
FIG. 2 is a perspective view of the electron gun system of the tube shown in FIG. 1.

For proper operation of the electron gun system it is necessary for certain electrodes of the three electron guns 6, 7 and 8 to be electrically interconnected. FIGS. 2 and 3 show in what manner this has been realized for a group of corresponding electrodes which are subjected to very narrow tolerances. Each of the three guns of the gun system shown in FIG. 2 comprises a control electrode 21 (also termed $G_1$), an anode 22 (also termed $G_2$), a focusing electrode 23 (also termed $G_3$) and an accelerating electrode 24 (also termed $G_4$). In each space surrounded by the beaker-shaped control electrodes 21 is a cathode which is arranged so as to be insulated with respect to the control electrode and which is not visible in the drawing. The electrodes of the three guns 6, 7 and 8 are positioned relative to each other by means of metal braces 25 which are welded thereto. The free ends 26 of the braces are embedded in four glass rods 27 in such manner that the free ends of the braces connected to two adjacent electrodes are embedded in each rod 27.

The gun system comprises a first group of corresponding electrodes formed by the electrodes 23, 23*a* and 23*b* and a second group of corresponding electrodes which are formed by the electrodes 24, 24*a* and 24*b* and which are to be operated at a higher electrical potential than the first group. The electrodes 23, 23*a* and 23*b* are electrically-connected by means of two metal contact springs 28 which are connected after assembling the gun system. The sectional view shown in FIG. 3 taken on the line III—III of FIG. 2 shows how the contact springs are connected. The end 29 of the contact springs 28 is engaged around a supporting rod 27. The end 30 hooks behind an opening 31 provided in a metal brace 25 of the electrode 23*a*. The part of a contact spring 28 situated between the ends 29 and 30 touches an electrode 23 (23*b*) as well as another supporting rod 27.

The corresponding electrodes 24, 24*a* and 24*b* may also be electrically-connected in an analogous manner by means of the contact springs, but the advantage of a small sensitivity to the occurrence of electrical flashover in the gun system is already obtained by interconnecting the electrodes 23, 23*a* and 23*b* in the manner shown.

Figure 4:
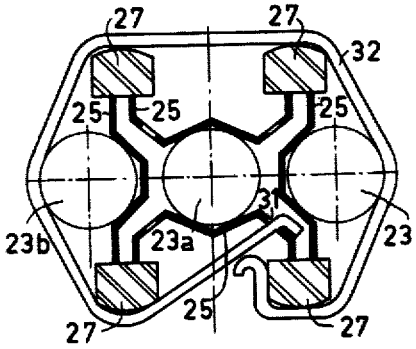
FIG. 4 is an analogous sectional view as shown in FIG. 3 in which the electrodes are electrically interconnected by means of one contact spring.

FIG. 4 is a sectional view analogous to that shown in FIG. 3. For simplicity, the components of the gun system are referred to by the same reference numerals as in FIG. 3. The contact springs 28, however, are replaced by one contact spring 32 which surrounds the supporting rods and touches the surfaces thereof.

It will be obvious that, with a slight modification of the shape of the contact springs, the invention may also be used in an electron gun system in which the electron guns are provided in the "delta configuration."

What is claimed is:

1. An electron gun system for a color television display tube, comprising three electron guns each extending along a longitudinal axis and including:

a first electrode electrically-connected to a corresponding first electrode of each of the other guns; and a second electrode to be operated at a different electrical potential than the first electrode, said second electrode being electrically-connected to a corresponding second electrode of each of the other guns;

said first and second electrodes being secured to insulating support rods by conductive braces connected thereto;

characterized in that at least said first electrodes are electrically-connected by means of at least one conductive contact spring surrounding the support rods and touching the surface of each electrode or of the brace connected thereto.

2. An electron gun system as in claim 1, characterized in that said electrically-connected electrodes are connected by at least two contact springs collectively surrounding the support rods, each contact spring having one end engaged around a support rod and having its other end secured to one of said braces, the part situated between said ends touching at least one electrode and at least one other supporting rod.

3. An electron gun system as in claim 1, characterized in that said electrically-connected electrodes are connected by one contact spring surrounding said support rods, having one end engaged around one of said support rods, and having its other end secured to one of said braces, the part situated between said ends touching at least two electrodes.

4. An electron gun system as in claim 1, 2, or 3, characterized in that one end of each contact spring hooks behind an opening provided in one of said braces.

* * * * *